US005375963A

United States Patent [19]

Wohlwend

[11] Patent Number: 5,375,963

[45] Date of Patent: Dec. 27, 1994

[54] MULTIPURPOSE LIFTING APPARATUS

[76] Inventor: Clayton E. Wohlwend, 2463 Newburg Rd., Fortuna, Calif. 95540

[21] Appl. No.: 5,434

[22] Filed: Jan. 19, 1993

[51] Int. Cl.[5] ..... B66C 5/00

[52] U.S. Cl. ..... 414/685; 212/265; 254/2 C; 414/917

[58] Field of Search ..... 414/685, 733, 917; 212/265, 261, 244; 254/2 C

[56] References Cited

U.S. PATENT DOCUMENTS

| | | | |
|---|---|---|---|
| 2,565,536 | 8/1951 | Valentine | 212/244 X |
| 2,792,139 | 5/1957 | Lloyd | 414/733 X |
| 3,059,785 | 10/1962 | Buckeye | 212/261 X |
| 3,184,086 | 5/1965 | Lull . | |
| 3,275,296 | 9/1966 | Meyer | 212/265 X |
| 4,215,971 | 8/1980 | Itey-Bernard . | |
| 4,669,703 | 6/1987 | Hawkins et al. . | |
| 4,749,324 | 6/1988 | Rulison | 212/265 X |
| 4,925,039 | 5/1990 | Macris . | |
| 5,052,566 | 10/1991 | Ziegler | 212/265 X |
| 5,211,526 | 5/1993 | Robinette | 212/244 X |

FOREIGN PATENT DOCUMENTS

| | | | |
|---|---|---|---|
| 2424682 | 12/1974 | Germany | 212/261 |

*Primary Examiner*—Donald W. Underwood
*Attorney, Agent, or Firm*—Richard C. Litman

[57] ABSTRACT

A lifting apparatus includes a mast that is mounted orthogonally (perpendicularly) to the plane of a base supported by wheels. A beam and tension member are connected pivotally to the mast and further to a carriage assembly support in such a manner that the support and mast maintain a parallel relationship, as do the beam and tension member. A lifting ram is pivotally connected to the mast and to the telescopic beam. During a load lifting operation, the resulting parallelogram configuration of the mast, carriage assembly support, beam, and tension member serve to maintain the tines of the carriage assembly in a plane parallel to the base of the lifting apparatus as the carriage assembly is arcuately raised. The carriage assembly and tension member may be removed in order for the mast and boom to be used as an engine hoist, and the apparatus may be further used as an engine work stand by installing a plate on the engine which is pivotally installable on the mast at the ram attachment point.

14 Claims, 3 Drawing Sheets

MULTIPURPOSE LIFTING APPARATUS

FIELD OF THE INVENTION

The present invention relates generally to portable hoists and lifting devices, and more particularly to a multipurpose lifting device which provides utility[as a fork lift, engine hoist, and engine stand.

BACKGROUND OF THE INVENTION

Traditionally, fork lift vehicles have been relatively heavy and bulky motorized vehicles which provided means for lifting heavy loads vertically by lifting the loads from below. The complexity of designing and manufacturing fork lifts has been transferred to purchasers in the form of higher prices. The servicing of fork lifts has also been an additional expense burdening fork lift owners. The operation of fork lifts has generally been performed only by those who are relatively skilled in maneuvering the machines. Known fork lift vehicles are relatively bulky and heavy, and require a considerable amount of power consumption. Although motorized fork lifts are needed in heavy industry, smaller fork lifts or hoists that are used less frequently would be useful in light industry, small warehouses, maintenance shops, and home use. These shortcomings of conventional forklifts have created a need for a relatively light and manually operated device which is capable of performing limited fork lift type operations, that provides several functions at an economical price yet is easy to manufacture, service, and operate.

Additionally, engine ,hoists and stands are commonly used in auto repair shops and service stations, and are provided by rental agencies for home auto repair. When the engine hoist is not in use, it normally occupies space if it is not disassembled and placed in storage. Similarly, an engine stand that is not incorporated into an engine hoist also occupies excess space if it is not disassembled and placed in storage. Furthermore, additional expenses are incurred in acquiring two devices, an engine hoist and an engine stand, if both devices can be incorporated into one structure. A novel apparatus is one that incorporates a fork lift device, engine hoist, and engine stand in one disassembleable structure that is portable, easy to transport, and saves storage space.

In accordance with one embodiment of the present invention, there is provided an apparatus for arcuately lifting loads by supporting the loads from below while the loads are situated on a horizontal platform. The portability inherent in the invention adds versatility by affording ease of handling while repositioning loads onto higher elevations such as shelves, roofs, trucks, and aircraft. This list is by no means exhaustive.

Another embodiment of the present invention includes an engine hoist with an engine stand configuration. The fork lift mechanism is easily removed to modify the lifting apparatus into an engine hoist, and alternatively, an engine stand. When an engine is removed from a vehicle by means of the engine hoist, there is no need to secure the engine to a separate engine stand. Instead, the engine is secured to an engine attachment plate and the plate is then inserted into a bracket secured to the forward face of a mast on the lifting apparatus. The multipurpose design of the lifting apparatus conserves the space needed to store the otherwise separate devices that would accomplish the same objectives as the present invention.

The simplicity of the present invention's construction affords light industry, small warehouses, repair shops, and homeowners, an inexpensive multipurpose lifting apparatus that is easy to use, transport, disassemble, and store.

DESCRIPTION OF THE PRIOR ART

Engine hoists and fork lifts are well known. Prior art lifts and the like have shortcomings that include: (1) inability to lift a load from below without swinging or tilting the load; (2) cumbersome accessibility to engine service and maintenance areas when the engine is attached to an engine stand; (3) no interchangeable parts that would otherwise transform an engine hoist into a fork lift, or alternatively, a fork lift into an engine hoist; (4) a requirement for powered operation, rather than manual operation; (5) fork lift devices are not easily disassembled for storage and transportation; and (6) fork lift devices are expensive to manufacture, service, and maintain.

U.S. Pat. No. 3,184,086 issued on May 15, 1963 to LeGrand H. Lull discloses a single purpose ]Lift truck that is bulky, heavy, and motorized, and is not easily dismantled or converted for other uses.

U.S. Pat. No. 4,215,971 issued to Georges Itey-Bernard on Aug. 5, 1080 discloses a lift truck or fork lift having an articulated lift mechanism. The device is powered and carries the operator in addition to any load being lifted, and as such is considerably heavier, more complex and more costly than the present invention. Moreover, no provision is made by Itey-Bernard for conversion of the device for use as an engine hoist or work stand.

U.S. Pat. No. 4,669,703 issued on Jun. 2, 1987 to Joel W. Hawkins and Patrick G. Hawkins discloses a wheeled hoist that is incapable of performing fork lift operations.

U.S. Pat. No. 4,925,039 issued on May 15, 1990 to James Macris discloses a portable folding crane that is easily dismantled but does not perform fork lift operations.

None of the above inventions and patents, taken either singly or in combination, is seen to describe the instant invention as claimed.

SUMMARY OF THE INVENTION

By the present invention, an improved lifting apparatus is provided which overcomes the above noted shortcomings and offers an operator of the lifting apparatus a means of quickly converting the lifting apparatus into a forklift, engine hoist, or engine stand by attaching or removing members from the lifting apparatus.

Accordingly, it is an object of the present invention to provide a means to lift a load vertically without disturbing the load by the transverse swinging or tilting actions associated with conventional hoists and cranes.

A further object of the present invention is to provide a manual means of lifting pallets and placing them on shelves, by means of the mechanical- advantage inherently provided in the present invention.

Another object of the present invention is to provide a means for transforming a conventional engine hoist into an apparatus capable of performing fork lift type operations.

An additional object of the present invention is to provide a means of lifting engines from automobiles, boats, and light aircraft engine compartments and the like.

Another object of the present invention is to provide a means for securing an engine to a work stand for ease of repair. The fork lift boom attachment is removable along with the lifting ram to provide greater work area access while working on an engine.

An additional object of the present invention is to provide a means of rotating an engine about its longitudinal axis when it is secured to the engine stand. By rotating an engine, hard to reach areas are more easily serviced It is a further object of the present invention to provide for ease of disassembly into five major components comprising the base, mast, lifting ram, carriage assembly, and beam. The invention is secured in its operating condition by standard heavy duty bolts or removable pins which may be spring loaded. By being easy to disassemble, the lifting apparatus is conveniently stored, transported, and transformed from one application to another.

Still another object of the present invention is to provide portability and provide an economical multipurpose alternative to motor powered single purpose fork lifts and engine hoists. Pneumatic tires may be attached for outdoor use.

It is an object of the invention to provide improved elements and arrangements thereof in an apparatus for the purposes described which is inexpensive, dependable and fully effective in accomplishing its intended purposes.

These and other objects Of the present invention will become readily apparent upon further review of the following specification and drawings.

BRIEF DESCRIPTION OF THE DRAWINGS

The invention will be better understood by reference to the accompanying drawings in which.

Similar reference characters denote corresponding features consistently throughout the attached drawings.

DETAILED DESCRIPTION OF THE PREFERRED EMBODIMENTS

Figure 1:
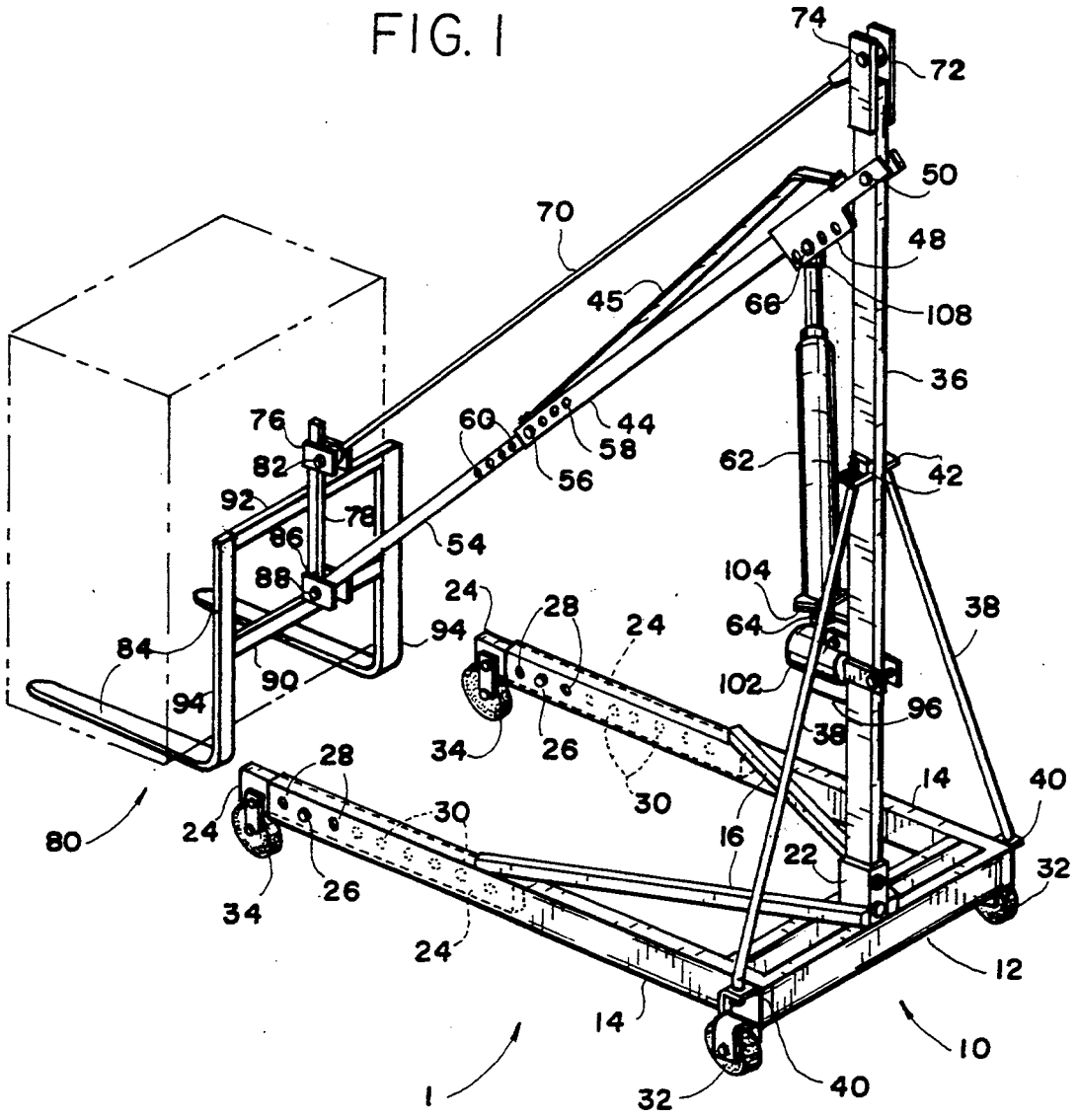
FIG. 1 is a perspective view of the lifting apparatus of the present invention in its fork lift configuration.

With reference to the drawings, particularly FIG. 1 of the drawings, a wheeled lifting apparatus 1 is illustrated having a base 10 formed from a transverse base member 12, and two longitudinal base members 14 extending forwardly. Two base braces 16 provide generally diagonal bracing between each longitudinal base member 14, and to the upwardly extending mast socket 22 that is situated medially on the transverse base member 12. The longitudinal base members 12 include a pair of base extensions 24 telescopically housed respectively in the two longitudinal base members 14 and provide for the adjustment of leg length. To adjust leg length, a locking pin 26 is inserted into any one of a plurality of holes 28 in the side wall of each longitudinal base member 14 and engages one of a plurality of cooperating telescopic base extension holes 30 in the side wall of the telescopic base extension 24. The base 10 is supported by caster wheels 32 at opposite ends of the transverse base member 12. Non-castering wheels 34 support the telescopic base extensions 24. The transverse base member 12, longitudinal base members 14, and telescopic base extensions 24 are preferably tubular and square in cross section.

A mast 36 is carried by the base 10 with the lower end of the mast 36 inserted into an Upwardly extending mast socket 22 medially situated on the transverse base member 12. Two bolts may be used to secure the lower end oil mast 36 in the upwardly extending socket 22. The mast 36 and the upwardly extending socket 22 are preferably tubular and square in cross section. The mast 36 extends generally vertically upward (assuming base 10 is horizontal) and is perpendicular to the transverse base member 12 and longitudinal members 14. The mast 36 is supported against lateral movement by two removable lateral support rods 38 having opposite first ends, which first ends are connected to the ends of the longitudinal base :members 14 by brackets 40, and extend upwardly and inwardly to! the medial section of the mast where they are secured at their second ends by brackets 42.

A beam 44 which is preferably tubular and square in cross section is welded or otherwise secured to a beam bracket 48 which is pivotally connected .to the mast 36 by a pivot pin 50, thus providing arcuate movement in the vertical plane for beam 44 and its associated components. An overlying support truss 45 is provided for beam 44 for additional bending strength. A shackle bracket 52 (FIG. 3) is attached to the beam 44 and is held securely in place by a set screw 53; rollers 55 provide for linear movement of bracket 52 along beam 44. A boom 54 is telescopingly inserted into the beam 44. and extends forwardly and aloha the same axis as the beam 44. The total length of the boom 54 and beam 44 can be adjusted by the insertion of a Din 56 into one of a plurality of holes 58 in the side walls of the beam 44; to engage one of a plurality of cooperating holes 60 in the side walls of the boom 54.

Figure 3:
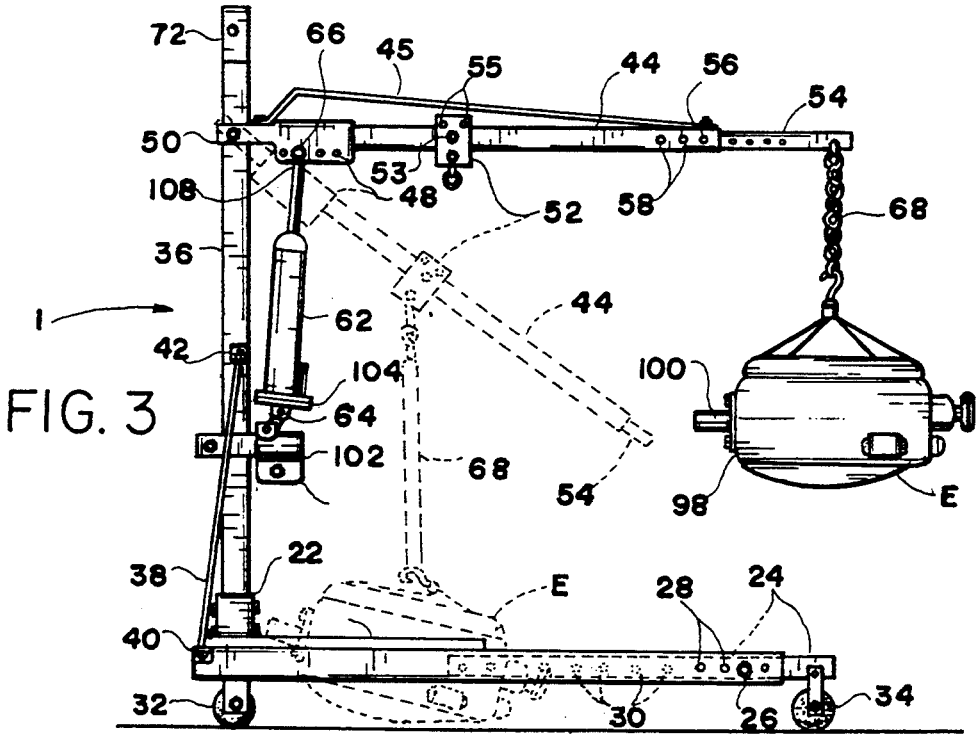
FIG. 3 is a side view of the apparatus in an engine hoist configuration with phantom lines denoting the: engine about to be attached to the engine stand bracket.

A lifting ram 62 that is preferably manually operated is bolted to the mast platform 104. The mast platform 104 is pivotally connected to the mast 36 by a pivot pin 64, thereby allowing for the angular changes in the geometry of the various components of apparatus 1 as it is operated. The upper end of the lifting ram 62 inserts into a female socket 108 which is pivotally connected to the beam bracket 48 by the insertion of a pivot pin 66 into one of a plurality of holes in the side of the beam bracket 48 and through a cooperating hole in the socket 108. The lifting ram 62 can be extended to elevate the beam 44 and thereby lift a load connected to the boom 54 via a chain and hook assembly 68, as shown in FIG. 3.

Ram 62 may be easily removed from the remainder of lifting apparatus 1 by relieving any load on beam 44, and removing pin 66 from bracket 48 at the upper end of ram 62, and removing pin 64 from the base of platform 104. Thus, ram 62 may be used as a hydraulic jack for other purposes when it is not needed for the operation of lifting apparatus 1, or may be removed for maintenance and/or repair. Preferably, ram 62 comprises a readily available hydraulic jack, of the type known as a "bottle jack" due to its general shape. Other lifting means may be used in the operation of lifting apparatus 1, in place of ram 62.

A tension component 70, comprising a rod, cable or other suitable component is pivotally connected by pivot pin 74 at one end to a mast bracket 72, which bracket 72 is welded or otherwise secured to the mast 36. Tension component 70 extends forward from the mast 36 to the first carriage bracket 76 connected to the vertical support 78 at the rear end of carriage assembly 80, and is mounted for pivotal movement by pivot pin 82 for self leveling of the horizontal leas or tines 84 of the carriage assembly.

Figure 2:
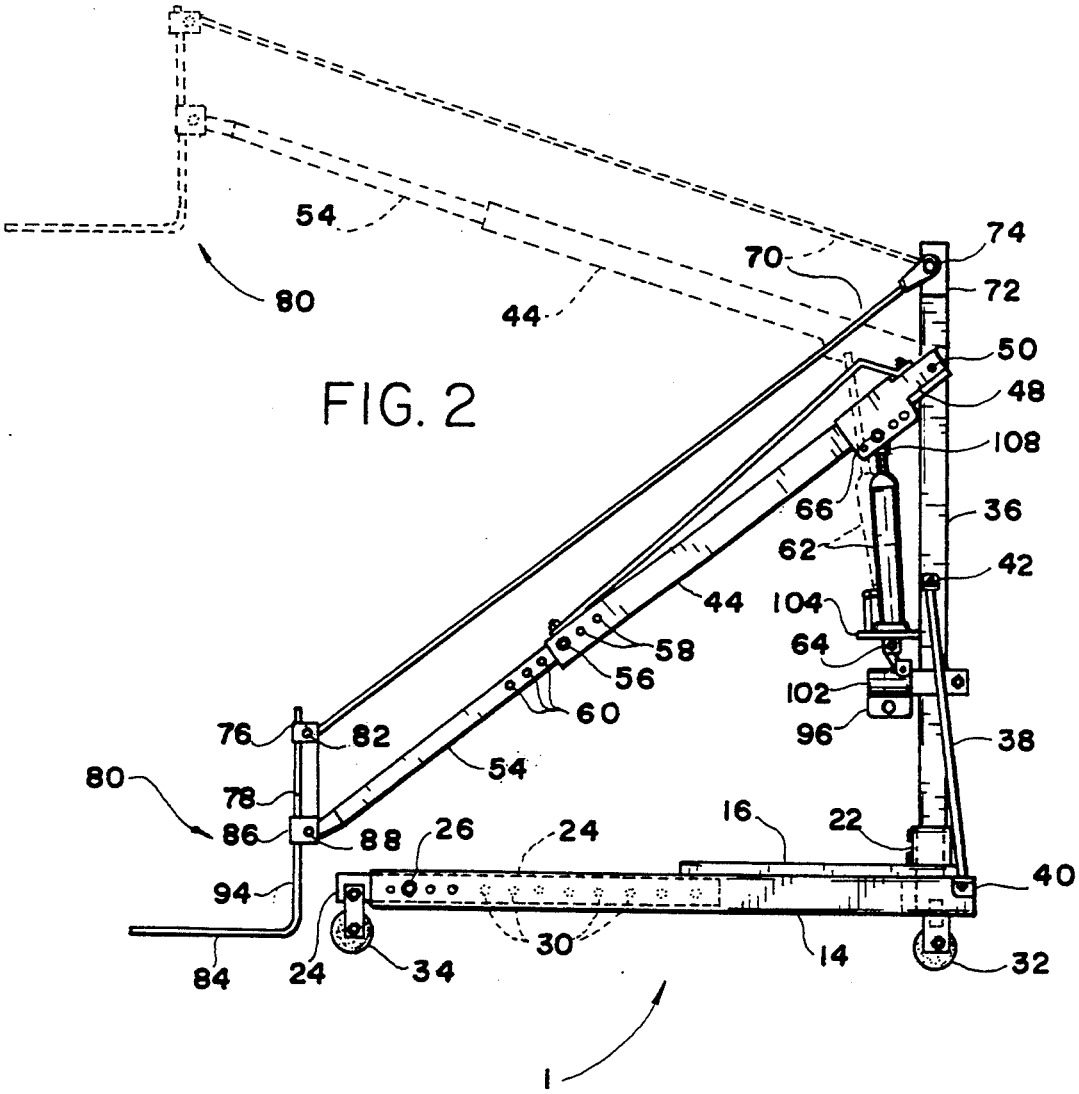
FIG. 2 is a side view of the lifting apparatus with phantom lines denoting range of motion.

The forward end of the boom is pivotally connected to the second carriage bracket 86 by a pivot Din 88. FIG. 2 shows that the tension component 70 remains parallel to the longitudinal axis of the beam 44 and boom 54 throughout the range of motion of the carriage assembly 80, as is shown by the phantom lines in FIG. 2 when the carriage assembly is lifted and lowered as a result of the parallelogram location of the four pivot points 50, 74, 82, and 88.

Furthermore, the vertical support 78 medially connected to the transverse members 90, 92 of the carriage assembly 80, remains parallel to the mast 36 throughout the range of motion of the carriage assembly 80 during lifting and lowering operations. The horizontal tines or leas 84 of the carriage assembly 80 remain parallel to the longitudinal base members 14 throughout the entire range of motion of lifting and lowering the carriage assembly 80.

Similarly, the vertical legs 94 of the carriage assembly 80 remain parallel to the mast 36 throughout the entire range of motion when lifting and lowering the carriage assembly 80. Pivot pins 50, 74, 82, and 88 form the pivot points of the parallelogram. Thus, with the parallelogram linkage formed by pivot pins 50, 74, 82, and 88, the plane defined by the legs 84 of carriage assembly 80 is maintained parallel at all times to the plane defined by the members comprising base 10 of lifting apparatus 1.

The carriage assembly 80 and accompanying tension component 70 may be used with other conventional engine hoists by adapting the tension component 70 to the mast of a conventional engine hoist, by connecting an extension to the topmost portion of the mast to provide a distance between the beam 44 and tension component 70 equal to the distance between the two pivot points of the carriage assembly 82, 88.

FIG. 3 shows the fork lift configuration of the lifting apparatus 1 being easily converted into an engine hoist by the removal of the carriage assembly 80 and anti-tilt rod 70 and with the addition of the chain and hook apparatus 68. An engine can be removed from an automobile, boat, or aircraft engine compartment with the lifting apparatus in the engine hoist configuration. Obviously, other large, heavy, and/or bulky objects may also be lifted by means of the above apparatus.

Figure 4:
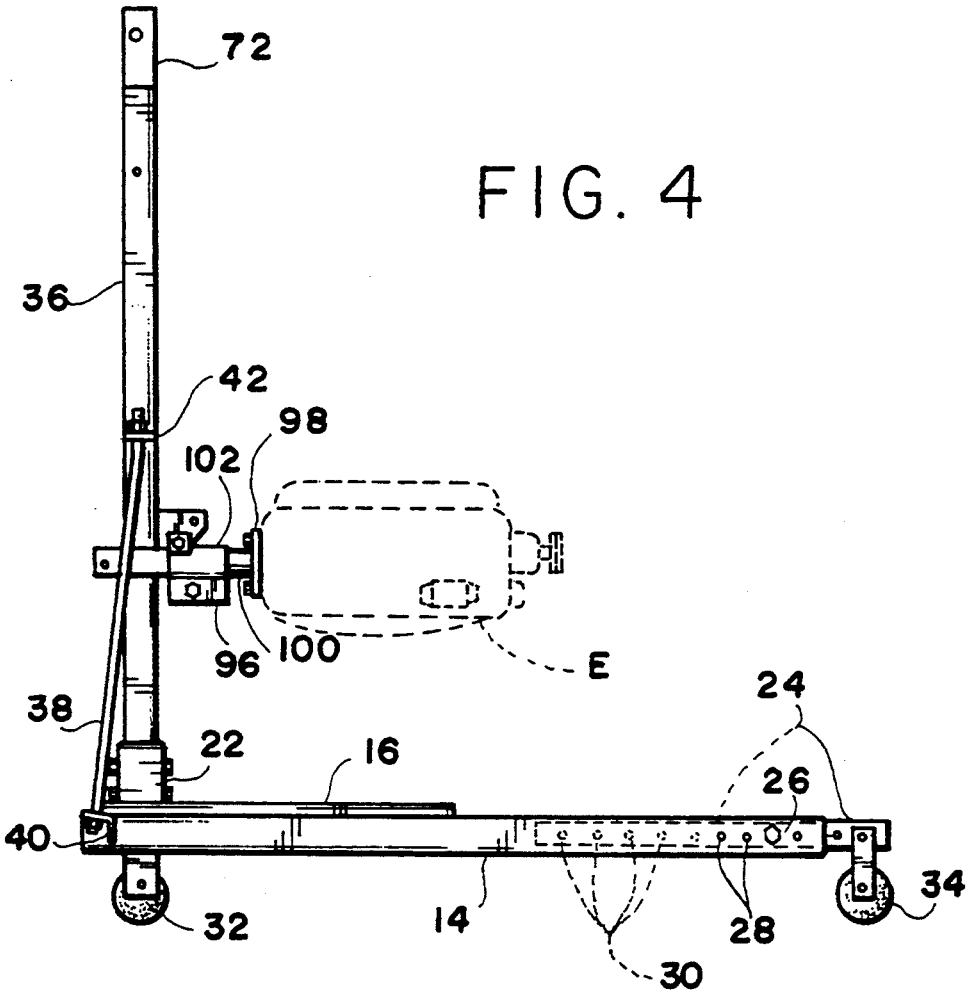
FIG. 4 is a side view of the apparatus in an engine stand configuration with carriage assembly and tension member detached.

Furthermore, FIG. 4 shows that the present invention can also be used as an engine stand by attaching an engine attachment bracket 96 to the front face of the mast 36. An engine E may be lifted from an engine compartment or other location by means of the chain and hook assembly 68 secured to the end of boom 54, in the even that some extension of beam 44 is needed, as shown in FIG. 3. In such a case, the engine E must be lowered to the surface and the chain 68 repositioned and attached to the shackle bracket 52 in order to allow the engine E toed! be repositioned and secured to the engine attachment bracket 96. Alternatively, the chain assembly 68 may be initially secured to the shackle bracket 52 and the shackle bracket 52 positioned along the beam 44 as appropriate, and the engine E lifted directly by the shackle bracket 52. Such a method is preferable, as the engine E need not be lowered and lifted again to reposition the chain assembly 68 from the end of the boom 54 to the shackle bracket 52. Assuming lifting apparatus 1 can be properly positioned with the shackle bracket 52 directly over the lifting point of the engine E, this method eliminates the additional step of repositioning the chain 68. Otherwise, the additional length provided by boom 54 may be used.

In any event, the beam 44 is lifted a sufficient height to allow the male connector 100 of the engine attachment plate 98 to be inserted into a female cylinder 102 in the engine attachment bracket 96. A clamp means (mot shown) is tightened in the side of the engine attachment bracket 96 to secure the engine E in place, if rotation of the engine E is not desired.

In accordance with the above disclosure, a portable, easily movable lifting device or apparatus is described. The device may be used as a lifting platform in lieu of a Dowered fork lift, and with little modification may be converted to an engine hoist or the like by means of the ready removal of the lifting platform components. The device may further be used as an engine work stand after an engine has been installed thereon. The lifting portions of the present invention may be manually actuated by means of the standard hydraulic jack disclosed herein, or may be manually actuated by mechanical or other means. Alternatively, powered actuation means of the lifting components may be installed if desired.

It is to be understood that the present invention is not limited to the embodiments described above, but encompasses any and all embodiments within the scope of the following claims.

I claim:

1. A lifting apparatus comprising:

a base defining a plane and including mast attachment means;

a mast having a first and a second end, with said mast first end secured to said base by said mast attachment means on said base and said mast extending orthogonally upward from said base;

said mast including beam attachment means at said second end of said mast and further including lifting jack attachment means having an engine attachment bracket and an engine attachment plate pivotally installable on said attachment bracket;

a beam having a first end pivotally secured to said mast by said beam attachment means and extending outward therefrom to an opposite second end;

a lifting jack having a first end and a second end, with said first end of said lifting jack pivotally cooperating with said lifting jack attachment means on said mast and said second end of said lifting jack pivotally cooperating with said beam attachment means on said mast to provide arcuate lifting of said beam;

a first and a second lateral support rod, each said lateral support rod having a first and a second end;

said first end of each said lateral support rod secured to said base on opposite sides of said mast and said second end of each said lateral support rod secured to opposite sides of said mast, thereby providing triangular reinforcement for said mast;

means providing for the removal of said lateral support rods and said masts respectively from said base and said mast attachment means;

a carriage assembly having a support with a first end and a second end, with said carriage assembly support parallel to said mast and with said second end of said beam pivotally secured to said first end of said carriage support;

said carriage assembly including first and second tines disposed parallel to said plane of said base and first and second legs extending respectively from said first and second tines;

said first and second legs secured together by means of first and second transverse members;

said first and second transverse members secured to said carriage assembly support; and a tension component having a first end and a second end, with said first end of said tension component pivotally secured to said second end of said mast and said second end of said tension component pivotally secured to said second end of said carriage assembly support and with said tension component parallel to said beam, whereby said carriage assembly is arcuately lifted by means of said lifting jack pivotally raising said beam, and said beam, said mast, said tension component, and said carriage assembly support define a parallelogram to maintain said carriage assembly support parallel to said mast as said carriage assembly is lifted.

2. The lifting apparatus of claim 1 including:

means providing for the telescoping extension of said second end of said beam.

3. The lifting apparatus of claim 1 including:

wheels supporting said base.

4. The lifting apparatus of claim 3 wherein:

said wheels include at least two steerable wheels and at least two non-steerable wheels.

5. The lifting apparatus of claim 1 wherein:

said base comprises a transverse base member having a first end and a second end:

a first and a second longitudinal base member, with each said longitudinal base member having a first end and a second end; and said first end of said first longitudinal base member secured normal to said first end of said transverse base member and said first end of said second longitudinal base member secured normal to said second end of said transverse base member, and said first and second longitudinal base members are parallel.

6. The lifting apparatus of claim 5 including:

first and second base braces, with each said base brace having a first end and a second end; and said first base brace first end qenerally medially secured to said first longitudinal base member and said second base brace first end generally medially secured to said second longitudinal base member and said first and said second ends of said base braces secured medially to said transverse base member, thereby providing triangulated reinforcement for said base.

7. The lifting apparatus of claim 5 including:

means providing for the telescoping extension of said second ends of said first and second longitudinal base members.

8. The lifting apparatus of claim 1 wherein:

said beam includes a shackle bracket.

9. The lifting apparatus of claim 1 including:

means providing for the removal of said lifting jack from said lifting apparatus, whereby said lifting jack is made portable.

10. The lifting apparatus of claim 1 wherein: said lifting jack comprises a hydraulic jack.

11. The lifting apparatus of claim 1 wherein: said lifting jack is manually powered.

12. The lifting apparatus of claim 1 including:

means providing for the removal of said carriage assembly from said beam and said tension component.

13. The lifting apparatus of claim 1 including:

means providing for the removal of said tension component from said mast.

14. The lifting apparatus of claim 1 wherein:

said base, said mast, and said beam are formed of square section tubular material.

* * * * *